US009917352B2

(12) United States Patent
Shin et al.

(10) Patent No.: US 9,917,352 B2
(45) Date of Patent: Mar. 13, 2018

(54) ANTENNA FOR VEHICLES

(71) Applicants: HYUNDAI MOBIS CO., LTD., Seoul (KR); INFAC ELECS CO., LTD., Incheon (KR)

(72) Inventors: Kyoung Sup Shin, Yongin-si (KR); Woo Jin Kim, Pyeongtaek-si (JP); Won Jong Lee, Chungju-si (KR); Song Hee Yang, Incheon (KR)

(73) Assignees: HYUNDAI MOBIS CO., LTD., Seoul (KR); INFAC ELECS CO., LTD., Incheon (KR)

( * ) Notice: Subject to any disclaimer, the term of this patent is extended or adjusted under 35 U.S.C. 154(b) by 624 days.

(21) Appl. No.: 14/536,304

(22) Filed: Nov. 7, 2014

(65) Prior Publication Data

US 2015/0130679 A1 May 14, 2015

(30) Foreign Application Priority Data

Nov. 8, 2013 (KR) ..... 10-2013-0135129

(51) Int. Cl.

| | |
|---|---|
| ***H01Q 1/48*** | (2006.01) |
| ***H01Q 1/27*** | (2006.01) |
| ***H01Q 1/24*** | (2006.01) |
| ***H01Q 1/32*** | (2006.01) |
| ***H01Q 21/28*** | (2006.01) |
| *H01Q 1/38* | (2006.01) |

(52) U.S. Cl.

CPC ..... *H01Q 1/27* (2013.01); *H01Q 1/241* (2013.01); *H01Q 1/3275* (2013.01); *H01Q 1/48* (2013.01); *H01Q 21/28* (2013.01); *H01Q 1/38* (2013.01)

(58) Field of Classification Search

CPC ..... H01Q 1/27; H01Q 1/38; H01Q 21/28; H01Q 1/48; H01Q 1/241; H01Q 1/3275

See application file for complete search history.

(56) References Cited

U.S. PATENT DOCUMENTS

2013/0234897 A1* 9/2013 Yoon ..... H01Q 19/00 343/700 MS
2014/0292593 A1* 10/2014 Thiam ..... H01Q 1/3275 343/713
2014/0368398 A1* 12/2014 Ying ..... H01Q 1/48 343/841

FOREIGN PATENT DOCUMENTS

KR 10-2010-0104739 A 9/2010
WO 2013/064872 A1 5/2013
WO 2013/090783 A1 6/2013

OTHER PUBLICATIONS

European Search Report dated Apr. 2, 2015 of corresponding European Patent Application No. 14 191 642.9—9 pages.

* cited by examiner

*Primary Examiner* — Graham Smith
*Assistant Examiner* — Noel Maldonado
(74) *Attorney, Agent, or Firm* — Knobbe Martens Olson & Bear LLP

(57) ABSTRACT

A antenna for vehicles may include: a main ground formed on a printed circuit board (PCB); a first LTE antenna ground connected to the main ground so as to ground a signal of a first LTE antenna; and a second LTE antenna ground connected to the main ground so as to ground a signal of a second LTE antenna. The first LTE antenna ground and the second LTE antenna ground may be left-right asymmetrically formed on the PCB.

7 Claims, 5 Drawing Sheets

ANTENNA FOR VEHICLES

CROSS-REFERENCES TO RELATED APPLICATIONS

The present application claims priority to Korean application number 10-2013-0135129, filed on Nov. 8, 2013, which is incorporated by reference in its entirety.

BACKGROUND

The present disclosure relates to an antenna for vehicles, and more particularly, to an antenna for vehicles, which is capable of securing isolation between LTE (Long Term Evolution) antennas, thereby minimizing interference between the LTE antennas.

In general, a vehicle antenna includes a GPS (Global Positioning System) antenna, a DMB (Digital Multimedia Broadcasting) antenna and the like.

The GPS antenna and an XM patch antenna have a structure that emits signals to the top of a vehicle. Furthermore, TMU (Telematics management unit), HSDPA (High-Speed Downlink Packet Access), and DMB antennas have a structure that emits signals in all directions of a vehicle, and signal interference between the respective antennas is small.

The related art of the present invention is disclosed in Korean Patent Laid-open Publication No. 10-2010-0104739 published on Sep. 29, 2010 and entitled "Shade band antenna installed in vehicle".

SUMMARY

An embodiment of the present invention is directed to an antenna for vehicles, which is capable of securing isolation between LTE antennas and reducing interference between the LTE antennas.

Another embodiment of the present invention is directed to an antenna for vehicles, which is capable of securing isolation between LTE antennas and improving the communication speed of LTE data.

In one embodiment, an antenna for vehicles may include: a main ground formed on a printed circuit board (PCB); a first LTE antenna ground connected to the main ground so as to ground a signal of a first LTE antenna; and a second LTE antenna ground connected to the main ground so as to ground a signal of a second LTE antenna. The first LTE antenna ground and the second LTE antenna ground may be left-right asymmetrically formed on the PCB.

A signal port of the first LTE antenna and a signal port of the second LTE antenna may be arranged in a left-right diagonal direction.

The LTE antenna ground may be integrated with the main ground.

The second LTE antenna ground may be formed to be physically separated from the main ground.

The second LTE antenna ground may include a top ground formed at the top part of the PCB and a bottom ground formed at the bottom part of the PCB, and the top ground and the bottom ground may be connected through a via hole.

The antenna may further include a current path unit configured to electrically connect the second LTE antenna ground to the main ground.

The current path unit may include a top current path unit configured to electrically connect the top ground and the main ground and a bottom current path unit configured to electrically connect the bottom ground and the main ground.

The current path unit may be formed to a length of (wavelength of operation frequency/4).

The first LTE antenna and the second LTE antenna may be formed in different shapes from each other.

The first LTE antenna and the second LTE antenna may be formed to have different areas from each other.

In accordance with the embodiments of the present invention, the antenna for vehicles may secure isolation between the LTE antennas, thereby reducing interference between the LTE antennas and improving LTE data communication speed.

DESCRIPTION OF SPECIFIC EMBODIMENTS

Embodiments of the invention will hereinafter be described in detail with reference to the accompanying drawings. It should be noted that the drawings are not to precise scale and may be exaggerated in thickness of lines or sizes of components for descriptive convenience and clarity only. Furthermore, the terms as used herein are defined by taking functions of the invention into account and can be changed according to the custom or intention of users or operators. Therefore, definition of the terms should be made according to the overall disclosures set forth herein.

The LTE (Long Term Evolution) specification is added to antennas for vehicles, and isolation between the respective antennas may be emerged as an important factor.

Thus, the MIMO (Multiple Input Multiple Output) antenna design technique has been applied. Examples of the MIMO antenna design technique may include a method of inserting an isolation element, a method of applying a diversity technique, and a method of using a decoupling network.

However, since the method of inserting an isolation element requires an additional space for an antenna, it is difficult to apply the method to a shark antenna. Furthermore, when the method of applying a diversity technique is used, it is difficult to intentionally change the position, direction, and polarization of an antenna. Furthermore, since the method of using a decoupling network can be applied only at a specific single frequency band, the method needs to be designed in a multi-band configuration in the case of LTE. Thus, the method of using a decouple network is not suitable for the method for securing isolation between MIMO antennas. A method for securing isolation using a new material may be developed. However, the method for securing isolation using a new material has a disadvantage in terms of price and mass production.

Figure 1:
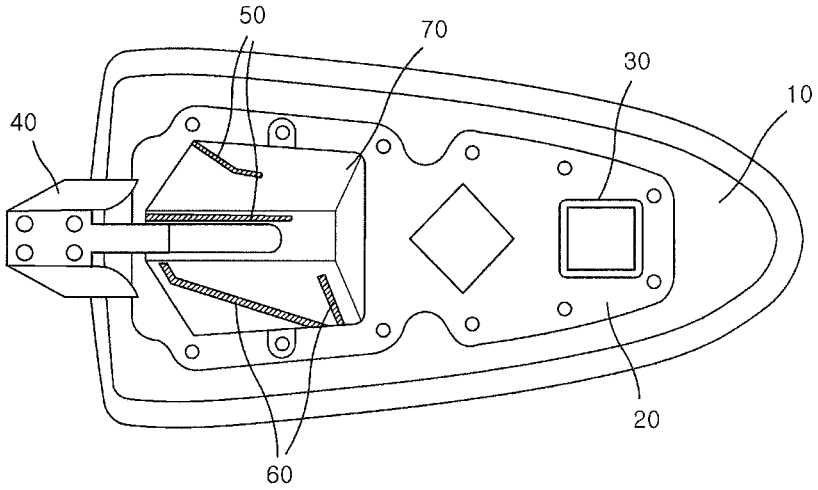
FIG. 1 is a configuration diagram of an antenna for vehicles in accordance with an embodiment of the present invention.
Figure 2:
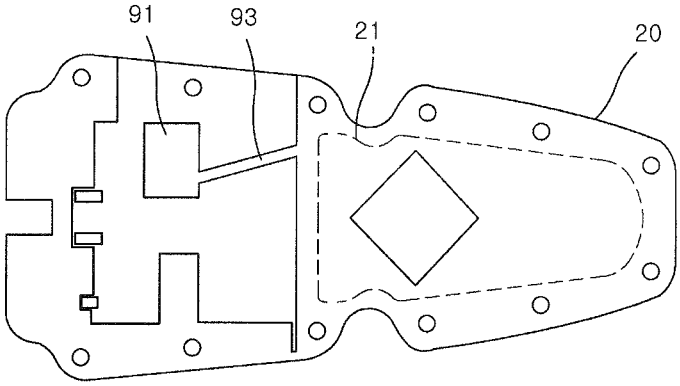
FIG. 2 is a diagram illustrating the ground structure of the top part of the antenna for vehicles in accordance with the embodiment of the present invention.
Figure 3:
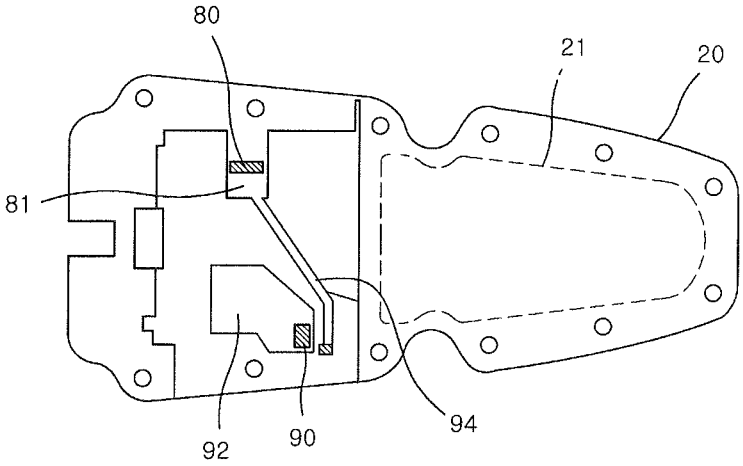
FIG. 3 is a diagram illustrating the ground structure of the bottom part of the antenna for vehicles in accordance with the embodiment of the present invention.
Figure 4:
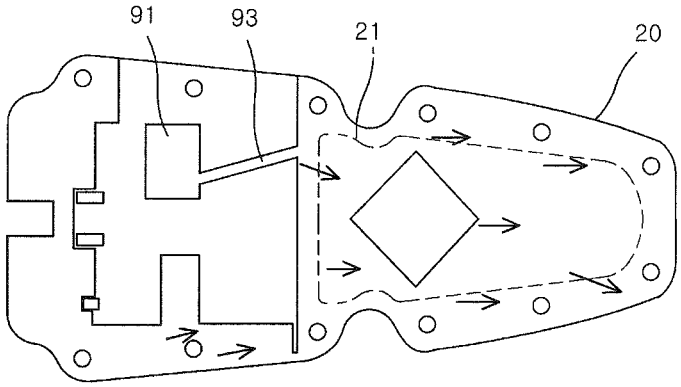
FIG. 4 is a diagram illustrating the ground current intensity of a second LTE (Long Term Evolution) antenna of the antenna for vehicles in accordance with the embodiment of the present invention.
Figure 5:
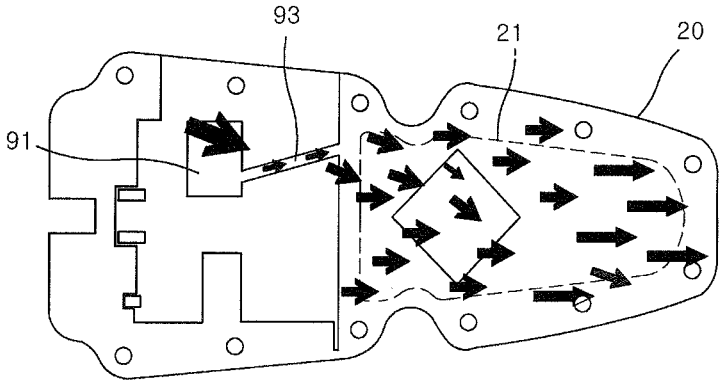
FIG. 5 is a diagram illustrating the ground current intensity of a first LTE antenna of the antenna for vehicles in accordance with the embodiment of the present invention.
Figure 6:
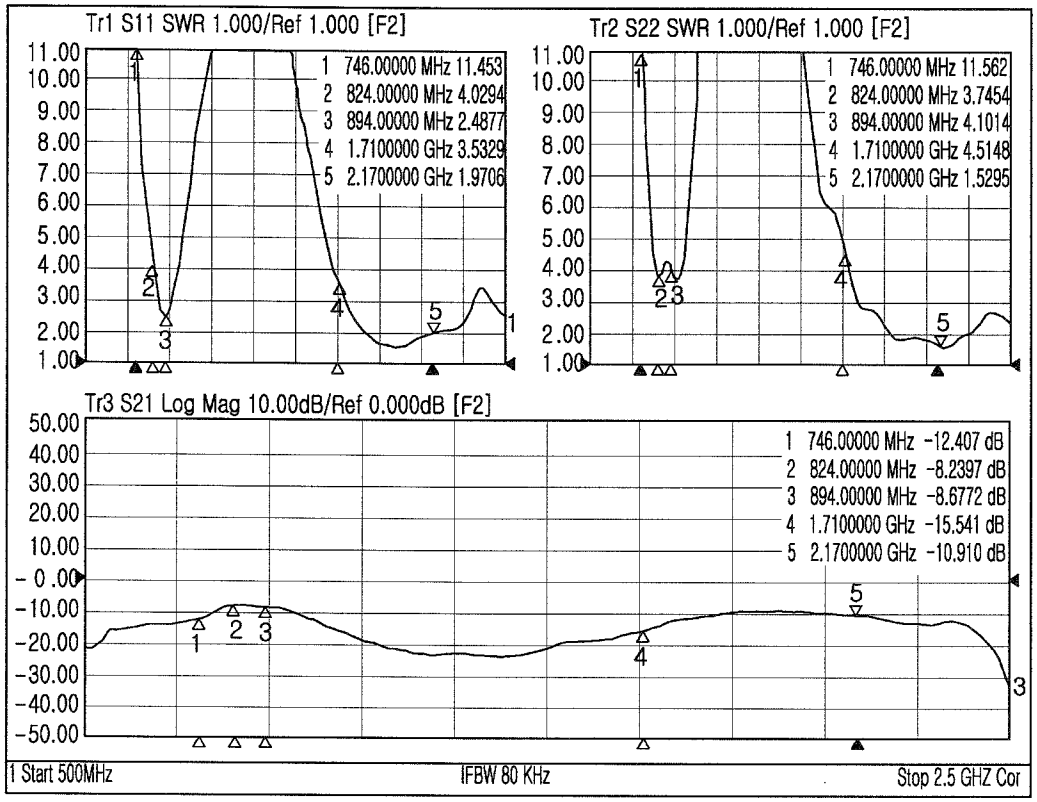
FIG. 6 is a diagram illustrating isolation characteristics of another antenna for vehicles.
Figure 7:
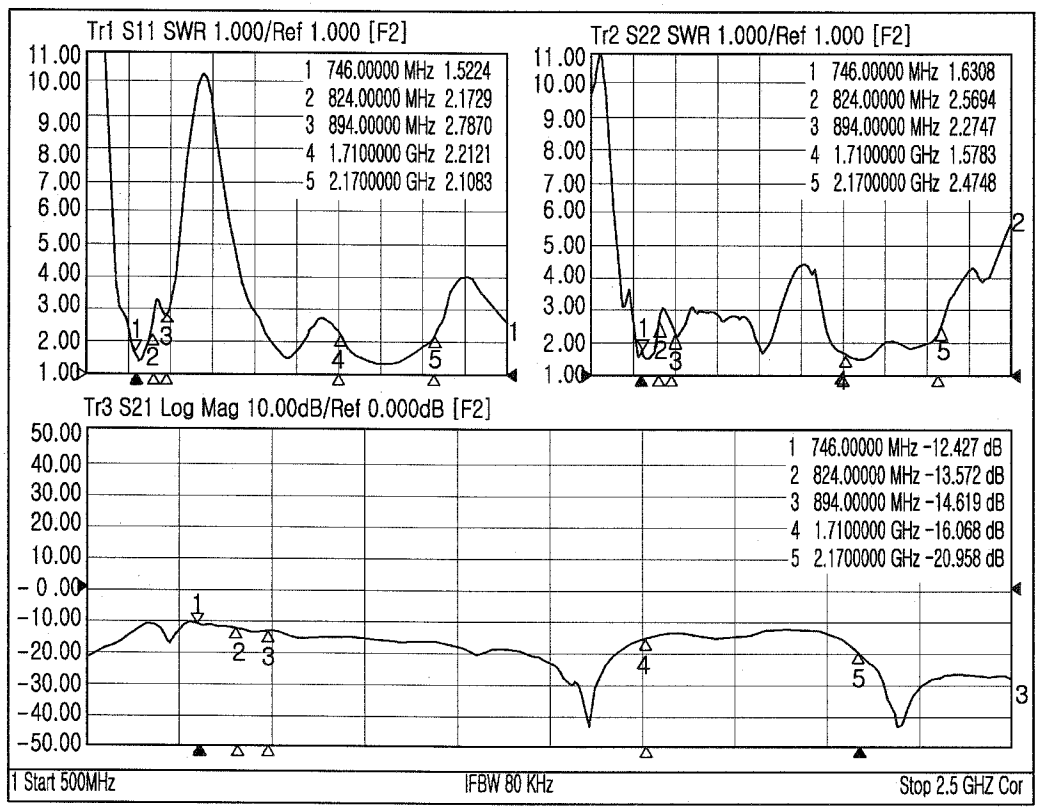
FIG. 7 is a diagram illustrating isolation characteristics of the antenna for vehicles in accordance with the embodiment of the present invention.

FIG. 1 is a configuration diagram of an antenna for vehicles in accordance with an embodiment of the present invention. FIG. 2 is a diagram illustrating the ground structure of the top part of the antenna for vehicles in accordance with the embodiment of the present invention. FIG. 3 is a diagram illustrating the ground structure of the bottom part of the antenna for vehicles in accordance with the embodiment of the present invention. FIG. 4 is a diagram illustrating the ground current intensity of a second LTE (Long Term Evolution) antenna of the antenna for vehicles in accordance with the embodiment of the present invention. FIG. 5 is a diagram illustrating the ground current intensity of a first LTE antenna of the antenna for vehicles in accordance with the embodiment of the present invention. FIG. 6 is a diagram illustrating isolation characteristics of another antenna for vehicles. FIG. 7 is a diagram illustrating isolation characteristics of the antenna for vehicles in accordance with the embodiment of the present invention.

Referring to FIG. 1, the antenna for vehicles in accordance with the embodiment of the present invention may include a GPS (Global Positioning System) antenna 30, a DMB (Digital Multimedia Broadcasting) antenna 40, a second LTE antenna 50, and a first LTE antenna 60.

The GPS antenna 30 is a ceramic patch antenna and may be installed at the front end so as to receive a GPS signal. The DMB antenna 40 may be installed at the back end so as to receive a DMB signal.

The DMB antenna 40 may be connected to a main ground 21 formed on a printed circuit board (PCB) 20. The DMB antenna 40 may be formed with a meander structure on the PCB 20, in order to secure an electrical length. Furthermore, a metal plate with a cap structure may be electrically connected to the top surface of the PCB 20, in order to improve receive (Rx) performance. The DMB antenna 40 may be formed in a monopole type for isotropic emission in all directions of a vehicle.

The GPS antenna 30 and the DMB antenna 40 operate as one-way receiving antennas. Thus, an LNA (Low Noise Amplifier) may be formed on the PCB 20 at the bottom of the GPS antenna 30 and the DMB antenna 40, in order to amplify a received signal.

On the other hand, the first and second LTE antennas 60 and 50 may be formed with a monopole-type structure for isotropic emission in all directions of the vehicle, and perform two-way communication. Thus, the first and second LTE antennas 60 and 50 may operate in a passive manner to which an LNA is not applied. Therefore, unlike the GPS antenna 30 and the DMB antenna 40, no LNA may be formed on the PCB 20 at the bottom of the first and second LTE antennas 60 and 50. As a result, on the PCB 20 at the bottom of the first and second antennas 60 and 50, various structures may be formed to improve the performance of the first and second LTE antennas 60 and 50.

A first LTE antenna signal port 80 connected to the first LTE antenna 60 and a second LTE antenna signal port 90 connected to the second LTE antenna 50 may be formed separately from each other. Through the first and second LTE antenna signal ports 80 and 90, signals of the first and second LTE antennas 60 and 50 may be inputted, respectively.

The first and second LTE antennas 60 and 50 may installed on a support unit 70 formed of a synthetic material such as plastic. The support unit 70 may spatially support the first and second LTE antennas 60 and 50 to efficiently operate. The first and second LTE antennas 60 and 50 may be obliquely installed along the structure of the above-described support unit 70.

The first and second LTE antenna signal ports 80 and 90 may be asymmetrically arranged in a left-right diagonal direction.

As illustrated in FIG. 3, the first and second LTE antenna signal ports 80 and 90 may be isolated as separately from each other as possible inside a case 10, while the first and second LTE antenna signal ports 80 and 90 are asymmetrically arranged in the left-right diagonal direction. Thus, the antenna isolation characteristic may be improved.

Furthermore, the grounds of the first and second LTE antennas 60 and 50 may be separated from each other.

Referring to FIGS. 2 and 3, a first LTE antenna ground 81 connected to the first LTE antenna 60 may be integrated with the main ground 21 formed on the PCB 20.

On the other hand, second LTE antenna grounds 91 and 92 connected to the second LTE antenna 50 may be independently formed so as to be physically isolated from the main ground 21 formed on the PCB 20.

The second LTE antenna grounds 91 and 92 may include a top ground 91 formed at the top part of the PCB 20 and a bottom ground 92 formed at the bottom part of the PCB 20. The top ground 91 and the bottom ground 92 may be electrically connected through a via hole (not illustrated).

Referring to FIGS. 2 and 3, the top ground 91 and the bottom ground 92 may be restrictively formed on the top and bottom parts of the PCB 20, respectively. When the top ground 91 and the bottom ground 92 have a small size, the second LTE antenna 50 may form a small electric field.

Typically, when a small electric field is formed, the amount of current flowing to the ground may decrease. However, as the small electric field is formed, the performance of the antenna may be degraded to reduce the gain of the antenna. Thus, the second LTE antenna grounds 91 and 92 may be electrically connected to the main ground 21 through current path units 93 and 94, respectively, and the isolation characteristic may be improved through the current path units 93 and 94.

The current path units 93 and 94 may include a top current path unit 93 for electrically connecting the top ground 91 and the main ground 21 and a bottom current path unit 94 for electrically connecting the bottom ground 92 and the main ground 21.

The current path units 93 and 94 may connect the top ground 91 and the bottom ground 92 to the main ground 21, respectively, so as to pass ground currents formed at the top ground 91 and the bottom ground 92 to the main ground 21.

At this time, the current path units 93 and 94 may be formed between the second LTE grounds 91 and 92 and the main ground 21, and set to such lengths that the current intensity of the first LTE antenna 60 is opposite to the current intensity of the second LTE antenna 50. For example, a difference in length between the current path units 93 and 94 may be set to (wavelength of operation frequency/4). In this case, a signal blocking characteristic and a current flow may be slowed down.

When the difference in length between the first LTE antenna grounds 81 and the second LTE antenna grounds 91 and 92 is set to (wavelength/4) such that the current intensity of the first LTE antenna ground 81 is opposite to the current intensity of the second LTE antenna grounds 91 and 92, the current interference between the first LTE antenna 60 and the second LTE antenna 50 may be minimized to obtain the isolation characteristic.

As a result, the main ground 21 may be utilized to substantially prevent the reduction in performance of the second LTE antenna grounds 91 and 92, and the electric fields may be concentrated on the top ground 91 and the bottom ground 92 so as to further improve the peak gain of the second LTE antenna 50.

FIGS. 4 and 5 illustrate the current flows of the first and second LTE antennas 60 and 50. Since the current flow of the first LTE antenna 60 illustrated in FIG. 4 has the opposite intensity of the current flow of the second LTE antenna 50 illustrated in FIG. 5, the current interference between the first and second LTE antennas 60 and 50 may be significantly reduced.

For reference, arrows illustrated in FIGS. 4 and 5 indicate the intensities of the current flows of the first and second LTE antennas 60 and 50.

As the current interference between the first and second LTE antennas 60 and 50 is minimized, the antenna isolation characteristic may be improved. The minimization of the current interference between the first and second LTE antennas 60 and 50 may be achieved through the current paths of the second LTE antenna grounds 91 and 92. For example, the difference in length between the current path units 93 and 94 may be set to (wavelength/4). Thus, when a wavelength of 850 MHz corresponds to about 37 cm, the difference in length between the current path units 93 and 94 may be set to about 8.75 cm.

That is, as the first and second antennas 60 and 50 are formed in different shapes and sizes, the transmission speed of signals inputted from the second LTE antenna 50 may slow down. Due to the difference of the transmission speed, a phase delay effect may be acquired. For example, when the current flow of the first LTE antenna 60 is maximized, the current flow of the second LTE antenna 50 may be minimized, and when the current flow of the first LTE antenna 60 is minimized, the current flow of the second LTE antenna 60 may be maximized.

Referring to FIGS. 6 and 7, when the other ground method is utilized, the same current flow may be formed in the ground. Thus, isolation between two LTE antennas may be relatively degraded. In FIG. 6, isolation at 800 MHz is about −8 dB, and does not satisfy a reference isolation of −10 dB, at which two LTE antennas are normally operated. Furthermore, since the same ground is utilized, matching performance between the antennas may be degraded.

On the other hand, in the antenna in accordance with the embodiment of the present invention, matching performance between the first and second LTE antennas 60 and 50 may be improved, and impedance matching performance may be improved. Furthermore, the isolation between the first and second LTE antennas 60 and 50 may be improved to −14 dB, compared to the other ground method.

That is, in the antenna in accordance with the embodiment of the present invention, the first LTE antenna 81 and the second LTE antenna grounds 91 and 92 may be differentially applied, and the current paths of the first LTE antenna ground 81 and the second LTE antenna grounds 91 and 92 may be differentially applied to differently form the current flow speed between the two antennas. Thus, the current interference between the first and second LTE antennas 60 and 50 may be minimized, and the isolation may be improved.

Although embodiments of the invention have been disclosed for illustrative purposes, those skilled in the art will appreciate that various modifications, additions and substitutions are possible, without departing from the scope and spirit of the invention as defined in the accompanying claims.

What is claimed is:

1. An antenna apparatus for vehicles, comprising:

a printed circuit board (PCB) comprising a top surface;

a raised support attached onto and raised from the top surface of the PCB, the raised support comprising a first slanted facet and a second slanted facet, each of which is slanted relative to the top surface;

a first Long Term Evolution (LTE) antenna comprising a first antenna portion formed on the first slanted facet;

a second LTE antenna comprising a second antenna portion formed on the second slanted facet;

a main ground formed on the PCB that is apart from the raised support when viewed in a direction perpendicular to the top surface;

a first ground formed on the PCB and under the raised support, the first ground connected to the first LTE antenna; and a second ground of the second LTE antenna formed on the PCB and under the raised support, the second around connected to the second LTE antenna, wherein the PCB comprises a first conductive line and a second conductive line, the first conductive line electrically interconnecting between the first ground and the main ground, the second conductive line electrically interconnecting between the second ground and the main ground, wherein the first and second grounds are physically separated from each other under the raised support, whereas the first and second grounds are electrically connected via the first conductive line, the second conductive line and the main ground.

2. The antenna apparatus of claim 1, wherein a signal port of the first LTE antenna and a signal port of the second LTE antenna are arranged in a left-right diagonal direction.

3. The antenna apparatus of claim 1, wherein the first ground is integrated with the main ground.

4. The antenna apparatus of claim 1, wherein the second ground comprises a top ground formed at the top surface of the PCB and a bottom ground formed at a bottom surface of the PCB, and the top ground and the bottom ground are connected through a via hole.

5. The antenna apparatus of claim 1, wherein the second conductive line is formed to a length of (wavelength of operation frequency/4).

6. The antenna apparatus of claim 1, wherein the first LTE antenna and the second LTE antenna are formed in different shapes from each other.

7. The antenna apparatus of claim 1, wherein the first LTE antenna and the second LTE antenna are formed to have different areas from each other.

* * * * *